US006213012B1

(12) United States Patent
Arms

(10) Patent No.: US 6,213,012 B1
(45) Date of Patent: Apr. 10, 2001

(54) GOLF BALL MARKING DEVICE

(76) Inventor: Christopher T. Arms, 1133 First Ave., Harvey, LA (US) 70058

( * ) Notice: Subject to any disclaimer, the term of this patent is extended or adjusted under 35 U.S.C. 154(b) by 0 days.

(21) Appl. No.: 09/356,263

(22) Filed: Jul. 16, 1999

Related U.S. Application Data

(60) Provisional application No. 60/093,569, filed on Jul. 20, 1998.

(51) Int. Cl.[7] ..... B41F 17/00

(52) U.S. Cl. ..... 101/35; 101/DIG. 40

(58) Field of Search ..... 101/35, DIG. 40, 101/114, 127, 129; 473/406, 409, 285

(56) References Cited

U.S. PATENT DOCUMENTS

| | | | | |
|---|---|---|---|---|
| 460,168 | | 9/1891 | Van Houten . | |
| 1,999,647 | * | 4/1935 | Atti | 101/DIG. 40 |
| 3,019,762 | | 2/1962 | Hautz . | |
| 3,161,041 | | 12/1964 | Amburgey . | |
| 3,310,879 | | 3/1967 | Brzezinski et al. . | |
| 3,512,262 | | 5/1970 | Smyk et al. . | |
| 3,797,123 | | 3/1974 | Fraley . | |
| 3,828,442 | | 8/1974 | Bernard . | |
| 4,546,644 | | 10/1985 | Beny et al. . | |
| 5,401,019 | | 3/1995 | Wissman et al. . | |
| 5,795,249 | * | 8/1998 | Johnson | 473/406 |

* cited by examiner

*Primary Examiner*—John S. Hilten
*Assistant Examiner*—Minh H. Chau
(74) *Attorney, Agent, or Firm*—Bracewell & Patterson, L.L.P.

(57) ABSTRACT

A golf ball marking device for drawing a line around the circumference of a golf ball is provided with an inner wall, an outer wall, and a top wall, whereby the golfer inserts the golf ball into the golf ball marking device, and using the top wall as a guide, places a mark on the circumference of the golf ball using a marking utensil.

19 Claims, 2 Drawing Sheets

40
18
10
15
25
19
21

20
40
25

40
30

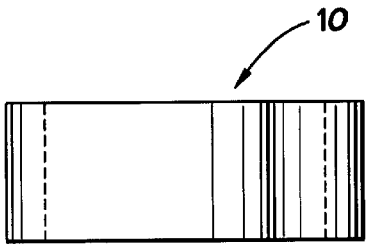
FIG. 4
FIG. 5
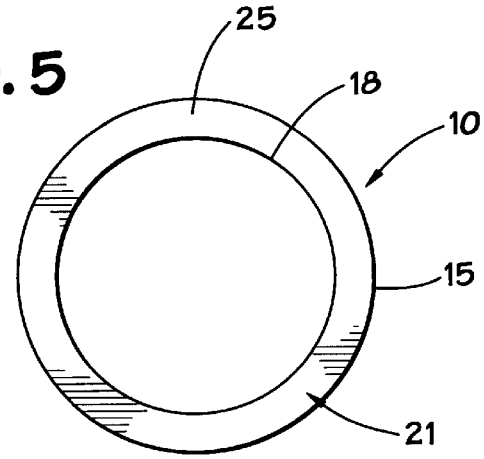
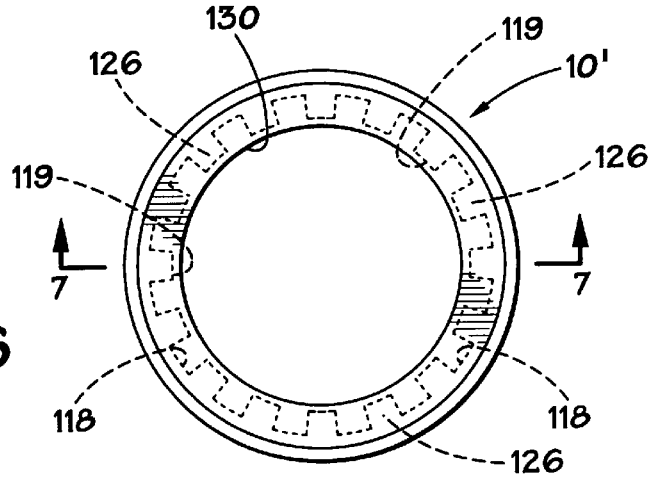
FIG. 6
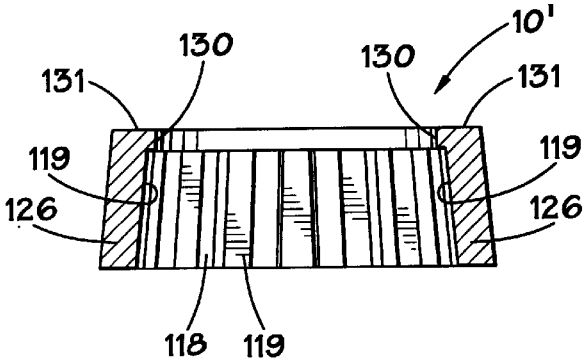
FIG. 7
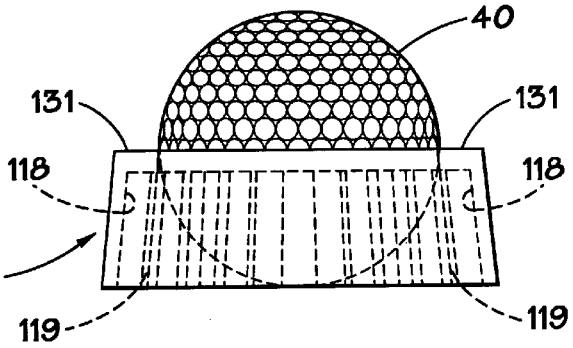
FIG. 8

GOLF BALL MARKING DEVICE

RELATED APPLICATIONS

This application claims the benefit of U.S. Provisional Application No. 60/093,569, filed Jul. 20, 1998.

BACKGROUND OF THE INVENTION

1. Field of the Invention

This invention relates generally to marking devices, and more particularly to a golf ball marking device that is used to draw a circumferential line around a golf ball for aiming purposes during putting.

2. Description of the Related Art

Anyone who plays golf seriously strives constantly to improve his or her score. Designers of golf equipment are constantly striving to provide the best possible clubs, balls, and other equipment for the golfer to assist the golfer in improving his or her score. One of the skills that a golfer needs to play the game successfully is the ability to aim accurately, especially during putting.

Typically, a player squats down and tries to aim the ball to the hole on the green with his eye, or he may use the golf club to help aim the ball. Alternatively, the golfer may use the golf ball manufacturer name on the ball as a guide. Similarly, the golfer could freehand draw a short line on the ball, and use that short line to help the golfer aim the ball.

The problem with aiming the ball just with your eyes or with the aid of a golf club is that the golfer does not have anything on the ball to help him align the ball with the hole on the green. Likewise, the problem the golfer could encounter by using the golf ball manufacturer's name on the ball to help the golfer align the ball with the hole is that the mark is typically neither straight nor uniform. Drawing a line on the golf ball freehand would not necessarily solve the problem either, since the line may be crooked. Even drawing a line using a straight edge may not necessarily help him aim the ball squarely toward the hole. This is because the golfer would only be estimating that the line drawn lies precisely on the circumference of the ball. Further, it may be very difficult to hold a rigid straight edge, such as a ruler, against the ball and at the same time draw the line around the ball.

Those skilled in the golf game know that having a line on the circumference of the golf ball would help the golfer to accurately aim the ball toward the hole. The device of the present invention enables the golfer to quickly mark the ball around the circumference of the ball without guessing where the circumference line should be. Furthermore, the line drawn using the device of the present invention could be viewed from all angles along the putt line since it lies around the circumference of the ball.

Accordingly, prior to the development of the present invention, there has been no golf ball marking device which: would enable a golfer to quickly and easily place a straight, uniform, circumferential mark on a golf ball; would enable a golfer to make the circumferential mark without guessing where the circumference of the ball was; and would enable a golfer to view the circumferential mark from all angles along the putt line. Therefore, the art has sought a golf ball marking device which: would enable a golfer to quickly and easily place a straight, uniform, circumferential mark on a golf ball; would enable a golfer to make the circumferential mark without guessing where the circumference of the ball was; and would enable a golfer to view the circumferential mark from all angles along the putt line.

SUMMARY OF THE INVENTION

The present invention is directed generally to a golf ball marking device. More specifically, the invention is directed to a golf ball marking device for drawing a line around the circumference of the golf ball. This circumferential line serves as a visual aid for the golfer in aiming the ball toward the hole on the putting green.

The golf ball marking device of the present invention may comprise: a marking utensil having a marking segment, the marking segment being adapted to make a mark on a golf ball; and a golf ball holder for holding the golf ball, the golf ball holder having an outer wall, an inner wall disposed within the outer wall, and a top wall that supports the marking segment of the marking utensil as the golf ball is marked. In this embodiment, the top wall is located between the inner wall and the outer wall.

In one specific embodiment of the present invention, the inner wall and outer wall are parallel to each other. In another specific embodiment, the inner wall slopes upwardly and inwardly. In another specific embodiment, the outer wall slopes upwardly and inwardly. In another specific embodiment, the marking utensil may be a conventional writing utensil. The conventional writing utensil may be a felt tip pen. In a further specific embodiment, the outer wall and the inner wall may form a hollow tubular member. Another embodiment of the golf ball marking device provides that the golf ball holder can hold the golf ball with an interference fit. Further, the inner wall of the golf ball marking device of the present invention has a height, and the golf ball has a diameter. The height of the inner wall, in one specific embodiment, may be less than one half of the diameter of the golf ball. In a further specific embodiment, the golf ball holder may be constructed of flexible plastic. Additionally, the inner wall of the present invention may be corrugated.

The present invention is also directed to a golf ball marking device adapted to mark a golf ball with a marking utensil comprising: a golf ball holder for holding the golf ball, the golf ball holder having an outer wall, an inner wall disposed within the outer wall, and a top wall adapted to support the marking utensil as the golf ball is marked. The top wall is generally located between the inner wall and the outer wall. In one specific embodiment, the inner wall and outer wall are parallel to each other. In another specific embodiment, the inner wall slopes upwardly and inwardly. In another specific embodiment, the outer wall slopes upwardly and inwardly. In another specific embodiment, the outer wall and the inner wall may form a hollow tubular member. In another embodiment, the golf ball holder preferably holds the golf ball with an interference fit. In a further specific embodiment, the inner wall has a height, and the golf ball has a diameter, and the height of the inner wall may be less than one half of the diameter of the golf ball. In another specific embodiment, the golf ball holder can be constructed of flexible plastic. In another specific embodiment, the inner wall can be corrugated.

The present invention is also directed to a method for marking a golf ball and may include the steps of: providing a marking utensil having a marking segment; providing a golf ball holder having an outer wall, an inner wall disposed within the outer wall, and a top wall; placing the golf ball having an equatorial circumference into the golf ball holder with the inner wall at least partially surrounding the golf ball and the top wall being adjacent to the equatorial circumference of the golf ball in at least one location; marking the golf ball with the marking utensil at a location corresponding to the at least one location that is adjacent to the equatorial circumference of the golf ball.

Another specific embodiment of the golf ball marking device of the present invention comprises: a golf ball holder member, for holding the golf ball, having an outer wall surface, an inner wall surface disposed within the outer wall surface, and a top surface located between the outer wall surface and the inner wall surface. In one specific embodiment, the outer wall surface is cylindrical in shape as is the inner wall surface. In this embodiment, the outer wall surface and the inner wall surface define a hollow tubular member. This hollow tubular member has a height that is approximately half the size of a conventional golf ball. The size of the opening formed in the tubular member is approximately the same size as a conventional golf ball, so that the golf ball can fit easily into, and lie firmly within, the device, preferably with a slight interference fit. The top surface of the tubular member has a width that is sufficient to provide room and support for the golfer to press a writing utensil, such as a pen or felt tip marker, against the inside edge of the top surface and the ball while tracing a line around the top surface.

In another embodiment, the inner cylindrical wall and the outer wall may not necessarily form a hollow cylindrical tubular member. For example, the outer wall surface may be in the shape of a box or a prism or any other geometrical shape and the inner wall surface may be in the shape of a square, triangle or other geometric shape, the alignment of the wall surfaces releaseably engaging the golf ball in a slight interference fit. Furthermore, the inner wall surface and the outer wall surface may not necessarily be limited to a height of half the size of a conventional golf ball, but could be slightly less to accommodate the thickness of the pen tip, so that the line drawn is exactly on the circumference of the golf ball. In a further embodiment, the inner wall surface of the golf ball holder is corrugated.

The golf ball marking device of the present invention, when compared with previously proposed prior art golf ball marking devices, has the advantages of: enabling a golfer to quickly and easily place a straight, uniform, circumferential mark on a golf ball; enabling a golfer to make the circumferential mark without guessing where the circumference of the ball was; and enabling a golfer to view the circumferential mark from all angles along the putt line.

BRIEF DESCRIPTION OF THE DRAWINGS

In the drawing:

FIG. 4 is a side view of the golf ball marking device shown in FIG. 1;

FIG. 5 is a top view of the device shown in FIG. 1;

FIG. 6 is a top view of an alternative embodiment of the golf ball marking device of the present invention;

FIG. 7 is a partial cross-sectional view of the device of FIG. 6, taken along line 7—7; and FIG. 8 is a side view of the device shown of FIG. 6.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by appended claims.

DETAILED DESCRIPTION OF THE INVENTION

Figure 1:
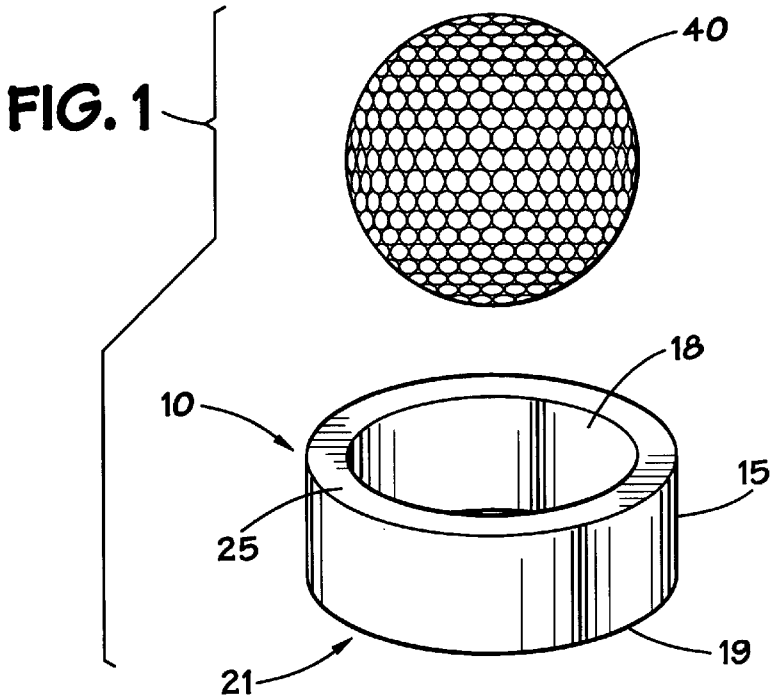
FIG. 1 is a perspective view of a golf ball and the golf ball marking device of the present invention.
Figure 2:
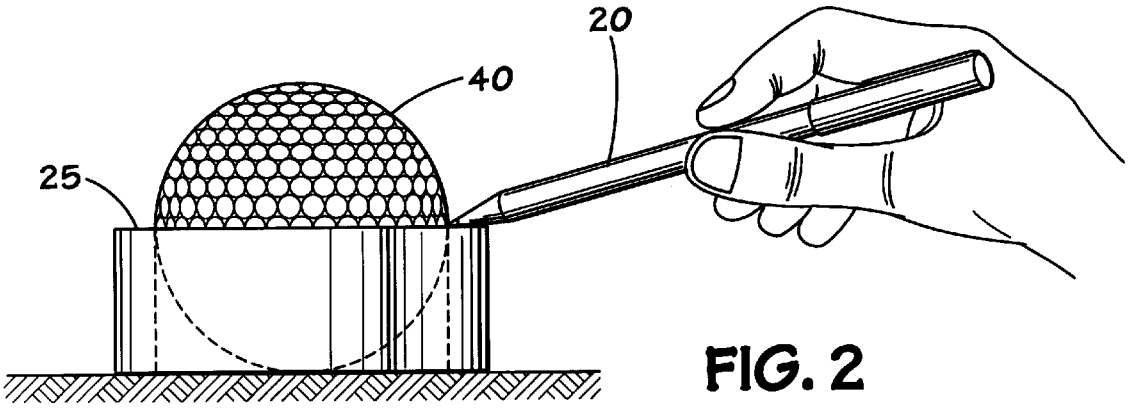
FIG. 2 is a side view of the golf ball marking device shown in FIG. 1, and more particularly shows a golfer's hand drawing a line around the circumference of the ball.
Figure 3:
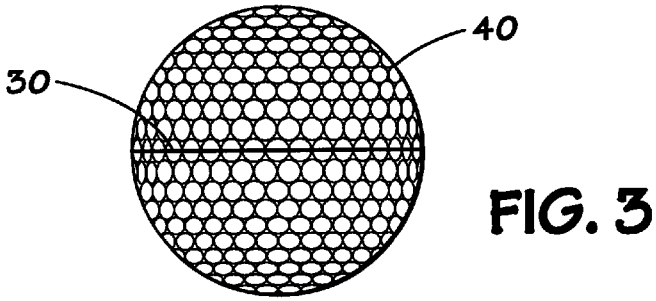
FIG. 3 is a golf ball with a line around its circumference.

Referring to the drawings, like reference numerals denote identical elements throughout the several views, and primed reference numerals are used to denote elements of similar, but not identical, construction. In FIG. 1 a specific embodiment of a golf ball marking device 10 is shown constructed in accordance with the present invention. With reference to FIGS. 1–5, the golf ball marking device 10 comprises: an outer wall surface 15; an inner wall surface 18; and a top surface 25 located between the outer wall surface 15 and the inner wall surface 18. In a specific embodiment, the outer wall surface 15 is cylindrical in shape. As shown in FIGS. 1 and 5, the inner and outer wall surfaces 18, 15 define a hollow tubular member 21. The height of the outer wall surface 15 and the inner wall surface 18 are the same and are approximately half the size of a conventional golf ball 40. The top surface 25, between the outer wall surface 15 and the inner wall surface 18, has a width sufficient to provide room and support for the tip of a writing utensil, or felt tip pen, 20 while drawing a line 30 (FIG. 3) around the golf ball 40 as shown in FIG. 2. The inner wall surface 18 has a circular cross-sectional area approximately the same as the cross-sectional area of a conventional golf ball 40, whereby the golf ball 40 can fit easily into, and firmly within, the device 10, preferably with a slight interference fit. In this specific embodiment, the bottom surface 19 of the golf ball marking device 10 is hollow and open, although a bottom wall (not shown) could be provided in another embodiment of the golf ball marking device 10. Inner wall surface 18 may be disposed substantially parallel to the outer wall surface 15, as shown in FIG. 2; or alternatively, inner surface 18 may slope inwardly and upwardly, and outer wall surface 15 may slope upwardly and inwardly, as shown in connection with the embodiment of device 10' of FIGS. 6–8.

It will be readily apparent to one of ordinary skill in the art that the outer wall surface 15 of the golf ball marking device 10 could have other shapes, e.g., a square, a triangle, a rectangle, etc.

The golf ball marking device 10 is preferably made from any suitable plastic or metallic material having the requisite strength characteristics to function as a golf ball marking device 10. Device 10 could also be made of wood. Golf ball marking device 10 can be made of any material that provides support for the tip of a pen 20 while drawing a line around 30 a golf ball 40 as shown in FIG. 2.

As shown in FIG. 2, to use the device 10, the golfer places the golf ball 40 inside the device 10 and then draws a line 30 around the ball 40 by pressing the writing utensil 20 against the inside edge of the top surface 25 and around the circumference of the ball 40. In one specific embodiment, the writing utensil 20 is a felt tip pen. The writing utensil 20 could also be a pencil, a ball point pen, a crayon, or any other conventional writing utensil that is capable of placing a visible mark on the golf ball 40. Once a line 30 is drawn around the circumference of the ball 40, the golfer is ready to use that line 30 on the ball 40 as a visual aid for aiming the ball 40 during putting.

FIGS. 6, 7, and 8 show an alternative embodiment of the golf ball marking device 10' of the present invention. The golf ball marking device 10' may be used by a golfer in much the same manner as golf ball marking device 10, discussed above. Golf ball marking device 10' includes an upper surface 131, an upper lip 130, and corrugations 126. The upper surface 131 may serve as a guide for writing utensil 20 (FIG. 2) as described above with respect to FIGS. 1–5. When the golfer inserts the golf ball 40 into the golf ball marking device 10', upper lip 130 preferably makes contact with the golf ball 40, and holds golf ball 40 with a slight interference fit. In this manner, the golf ball 40 generally will not fall out of golf ball marking device 10' until the golfer removes it.

The golf ball marking device 10' preferably ha s vertical corrugations 126. Each corrugation 126 generally has an inner surface 118, and an outer surface 119. In FIG. 6, the corrugations 126 are shown as having a generally square cross-sectional configuration. However, it is contemplated that the corrugations could have a triangular, semicircular or any other shaped cross-sectional configuration. Though FIG. 6 shows several small corrugations 126, the present invention contemplates that any number of corrugations 126 could be used. Further, the corrugations may vary in size or width depending upon the material used to construct the device 10 or other manufacturing or use conditions. The corrugations 126 are shown in FIGS. 6–8 as sloping upwardly and inwardly, however, the corrugations 126 may be vertical. Further, inner surface 118 is shown as being substantially parallel to outer surface 119, however, inner surface 118 could be vertical, while outer surface 119 could slope upwardly and inwardly. The corrugations 126 allow the golf ball marking device 10' to flex when the golf ball 40 is inserted, but at the same time, corrugations 126 provide sufficient rigidity to allow upper lip 130 to hold golf ball 40 in a slight interference fit.

It is to be understood that the invention is not limited to the exact details of construction, operation, exact materials or embodiments shown and described, as obvious modifications and equivalents will be apparent to one skilled in the art; for example, the outer wall could be a different height than the inner wall and the top surface could correspondingly be sloped. Accordingly, the invention is therefore to be limited only by the scope of the appended claims.

I claim:

1. A golf ball marking device comprising:

a marking utensil having a marking segment, the marking segment being adapted to make a mark on a golf ball; and a golf ball holder for holding the golf ball, the golf ball holder having an outer wall, an inner wall disposed within the outer wall, the inner wall being corrugated and a top wall that supports the marking segment of the marking utensil as the golf ball is marked, the top wall being located between the inner wall and the outer wall.

2. The golf ball marking device of claim 1, wherein the inner wall and outer wall are parallel to one another.

3. The golf ball marking device of claim 1, wherein the inner wall slopes upwardly and inwardly.

4. The golf ball marking device of claim 1, wherein the outer wall slopes upwardly and inwardly.

5. The golf ball marking device of claim 1, wherein the marking utensil is a writing utensil.

6. The golf ball marking device of claim 5, wherein the writing utensil is a felt tip pen.

7. The golf ball marking device of claim 1, wherein the outer wall and the inner wall form a hollow tubular member.

8. The golf ball marking device of claim 1, wherein the golf ball holder holds the golf ball with an interference fit.

9. The golf ball marking device of claim 1, wherein the inner wall has a height, and the golf ball has a diameter, and the height of the inner wall is less than one half of the diameter of the golf ball.

10. The golf ball marking device of claim 1, wherein the golf ball holder is constructed of flexible plastic.

11. A golf ball marking device adapted to mark a golf ball with a marking utensil comprising:

a golf ball holder for holding the golf ball, the golf ball holder having an outer wall, an inner wall disposed within the outer wall, the inner wall being corrugated, and a top wall adapted to support the marking utensil as the golf ball is marked, the top wall being located between the inner wall and the outer wall.

12. The golf ball marking device of claim 11, wherein the inner wall and outer wall are parallel to one another.

13. The golf ball marking device of claim 11, wherein the inner wall slopes upwardly and inwardly.

14. The golf ball marking device of claim 11, wherein the outer wall slopes upwardly and inwardly.

15. The golf ball marking device of claim 11, wherein the outer wall and the inner wall form a hollow tubular member.

16. The golf ball marking device of claims 11, wherein the golf ball holder holds the golf ball with an interference fit.

17. The golf ball marking device of claim 11, wherein the inner wall has a height, and the golf ball has a diameter, and the height of the inner wall is less than one half of the diameter of the golf ball.

18. The golf ball marking device of claim 11, wherein the golf ball holder is constructed of flexible plastic.

19. A method for marking a golf ball comprising the steps of:

providing a marking utensil having a marking segment;

providing a golf ball holder having an outer wall, a corrugated inner wall disposed within the outer wall and a top wall;

placing the golf ball having an equatorial circumference into the golf ball holder with the inner wall at least partially surrounding the golf ball and the top wall being adjacent to the equatorial circumference of the golf ball in at least one location;

marking the golf ball with the marking utensil at a location corresponding to the at least one location that is adjacent to the equatorial circumference of the golf ball.

* * * * *